United States Patent [19]

Foster

[11] Patent Number: 5,009,800

[45] Date of Patent: Apr. 23, 1991

[54] FABRIC SOFTENING ADDITIVE FOR DETERGENT COMPOSITIONS: CELLULOSE ETHER AND ORGANIC FABRIC SOFTENER

[75] Inventor: Francis G. Foster, Wirral, England

[73] Assignee: Lever Brothers Company, Division of Conopco Inc., New York, N.Y.

[21] Appl. No.: 537,225

[22] Filed: Jun. 13, 1990

Related U.S. Application Data

[63] Continuation of Ser. No. 278,696, Dec. 1, 1988, abandoned.

[30] Foreign Application Priority Data

Dec. 1, 1987 [GB] United Kingdom ..... 8728958

[51] Int. Cl.[5] ..... C11D 1/62; C11D 3/22

[52] U.S. Cl. ..... 252/8.9; 8/137; 252/8.6; 252/8.8; 252/174.19; 252/528; 252/547; 252/DIG. 2; 252/DIG. 15

[58] Field of Search ..... 252/8.9, 8.6

[56] References Cited

U.S. PATENT DOCUMENTS

| | | | |
|---|---|---|---|
| 3,920,561 | 11/1975 | DesMarais | 252/8.8 |
| 4,020,015 | 4/1977 | Bevan | 252/544 |
| 4,230,590 | 10/1980 | Wixon | 252/97 |
| 4,298,480 | 11/1981 | Wixon | 252/8.75 |
| 4,379,059 | 4/1983 | Hockey et al. | 252/8.8 |
| 4,540,499 | 9/1985 | Sakatani et al. | 252/8.75 |

FOREIGN PATENT DOCUMENTS

| | | |
|---|---|---|
| 100125 | 2/1984 | European Pat. Off. . |
| 213730 | 3/1987 | European Pat. Off. . |
| 1498520 | 1/1978 | United Kingdom . |
| 1534641 | 12/1978 | United Kingdom . |

OTHER PUBLICATIONS

South African Application 71/5149.

*Primary Examiner*—A. Lionel Clingman
*Attorney, Agent, or Firm*—Gerard J. McGowan, Jr.

[57] ABSTRACT

A particulate fabric softening additive for detergent compositions comprises (a) a cellulose ether and (b) an organic fabric softener in intimate mixture. The weight ratio of (a) to (b) is from 1:1 to 0.06:1, such as from 1:4 to 1:9. Component (a) is nonionic, water-soluble with an HLB of 3.3 to 3.8 and a gel point of 33° C. to 56° C. Some commercial alkyl, hydroxyalkyl derivatives satisfying these conditions are disclosed. Component (b) may be a conventional quaternary ammonium salt. By forming these components into an intimate particulate mixture, softening performance is improved.

7 Claims, No Drawings

FABRIC SOFTENING ADDITIVE FOR DETERGENT COMPOSITIONS: CELLULOSE ETHER AND ORGANIC FABRIC SOFTENER

This is a continuation application of Ser. No. 278,696, filed Dec. 1, 1988, now abandoned.

This invention relates to a fabric softening additive for detergent compositions, in particular for compositions which are capable of softening natural fibre wash load articles without causing redeposition problems on any synthetic fibre fabrics in the load.

A detergent composition of this type is described in European Patent Specification EP-A-213730 (Unilever) according to which the composition contains both a fabric softening agent and a water-soluble nonionic cellulose ether of a selected class, defined in terms of, HLB, gel point and the nature of the substituents on the cellulose ether. The described compositions may be prepared by including the cellulose ether in a slurry with other ingredients and then spray-drying or it may simply be dry-mixed with other ingredients. While successful results can be obtained with these methods of incorporation we have now surprisingly discovered that better fabric softening results can be obtained if the cellulose ether is added in the form of a particulate additive which also contains the fabric softening agent.

Thus according to the invention there is provided a particulate fabric softening additive for detergent compositions, comprising as the sole or major component, an intimate mixture of a water-soluble nonionic cellulose ether and an organic fabric softening agent in the weight ratio of from 1:1 to 0.06:1, the cellulose derivative being selected from alkyl celluloses and alkyl hydroxyalkyl celluloses in which the alkyl group is selected from methyl and ethyl and the hydroxyalkyl group is selected from hydroxyethyl and hydroxypropyl, the cellulose ether having an HLB (as herein defined) of between 3.3 and 3.8, and a gel point of between 33° C. and 56° C.

The fabric softening additive is in particulate form. Preferably a substantial majority of the particles have a size of between 50 to 1000 microns, most preferably from 50 to 500 microns. It may be added directly to a wash liquor or alternatively may be included in a fabric treatment composition which already contains a non-soap anionic detergent active material or a mixture thereof with other non-soap detergent active materials, in an amount of from 2% to 50% by weight. A suitable level for the additive in such a composition is from 1.0% to 53% by weight, so as to yield in the final composition an overall cellulose ether level of 0.5% to 3% and a fabric softening agent level of 0.5% to 50%.

The cellulose ether and the organic fabric softening agent will normally be the only components of the additive, although minor amounts of other components may also be present. Such other components may include other cellulose ether materials, other fabric softening agents, dispersing aids and inert fillers.

The useful substituted cellulose ethers are defined in part by their HLB. HLB is a well known measure of the hydrophilic-lyophilic balance of a material and can be calculated from its molecular structure. A suitable estimation method for emulsifiers is described by J T Davies, 2nd Int Congress of Surface Activity 1957, I pp 426–439. This method has been adopted to derive a relative HLB ranking for cellulose ethers by summation of Davies's HLB assignments for substituent groups at the three available hydroxyl sites on the anhydroglucose ring of the polymer. The HLB assignments for substituent groups include the following:

| | | |
|---|---|---|
| Residual hydroxyl | 1.9 | |
| Methyl | 0.825 | |
| Ethyl | 0.350 | |
| Hydroxy ethyl | 1.63 | |
| Hydroxy propyl | 1.15 | |
| Hydroxy butyl | 0.67 | (by extrapolation from Davies) |

The cellulose ethers useful herein are polymers which are water-soluble at room temperature. The gel point of polymers can be measured in a number of ways. In the present context the gel point is measured on a polymer solution prepared by dispersion at 60°/70° C. and cooling to 20°/25° C. at 10 g/l concentration in deionised water. 50 ml of this solution placed in a beaker is heated, with stirring, at a heating rate of approximately 5° C./minute. The temperature at which the solution clouds is the gel point of the cellulose ether being tested and is measured using a Sybron/Brinkmann colorimeter at 80% transmission/450 nm.

Provided that the HLB and gel point of the polymer fall within the required ranges, the degree of substitution (DS) of the anhydroglucose ring may be any value up to the theoretical maximum value of 3, but is preferably from about 1.9–2.9, there being a maximum of 3 hydroxyl groups on each anhydroglucose unit in cellulose. The expression 'substitution' (MS) is sometimes also used in connection with these polymers and refers the number of hydroxyalkyl substituents per anhydroglucose ring and may be more than 3 when the substituents themselves carry further substituents.

The cellulose ethers preferred in the present invention have an average number of anhydroglucose units in the cellulose polymer, or weight average degree of polymerisation (DP), from about 50 to about 1,200.

A number of cellulose ethers suitable for use in the present invention are commercially available, as follows:

| Trade Name | Gel point °C. | HLB (Davies) | DS/MS alkyl/hydroxalkyl |
|---|---|---|---|
| BERMOCOLL CST035 (ex Berol Kemi) | 35 | 3.40 | 1.4 ethyl<br>0.5 hydroxyethyl |
| BERMOCOLL E481 (ex Berol Kemi) | 56 | 3.77 | 0.9 ethyl<br>2.0 hydroxyethyl |
| TYLOSE MHB 1000 (ex Hoechst) | 54 | 3.52 | 2.0 methyl<br>0.1 hydroxyethyl |
| PROBE D (Ex Hoechst) | 33 | 3.01 | 2.5 methyl |

A number of other cellulose ethers are known from the prior art, but have been found to be unsuitable for use in the present invention. Thus, British Specification No GB 2 038 353B (COLGATE-PALMOLIVE) discloses TYLOSE MH 300 (ex Hoechst) which has a gel point of 58° C. and METHOCEL XD 8861 (ex Dow Chemical Company, now coded METHOCEL HB12M) which contains about 0.1 hydroxybutyl substituents per anhydroglucose ring, while Japanese Patent Specification No 59-6293 (LION KK) discloses KLUCEL H (ex Hercules Chemical Corp) which has an HLB of about 4.4, METHOCEL K4M (ex Dow Chemical Company) which has a gel point of about 69° C., and NATROSOL 250H (ex Hercules Chemical Corp) which has an HLB of about 6.9.

A second essential component of the additives of the present invention is an organic fabric softening agent which may be selected from quaternary ammonium compounds, imidazolinium derivatives (both of which are cationic fabric softening agents), fatty amines, soaps, organo-modified fabric softening clays and mixtures thereof.

The fabric softening material is preferably a cold water-insoluble material, that is a material having a solubility at 20° C. of less than 10 g/1 in water at a pH value of about 6 or a material which will form an insoluble calcium salt in hard water.

Highly preferred water-insoluble quaternary ammonium compounds are those having two $C_{12}$–$C_{24}$ alkyl or alkenyl chains, optionally substituted by functional groups such as —OH, —O—, —CONH, —COO— etc.

Well known species of substantially water-insoluble quaternary ammonium compounds have the formula

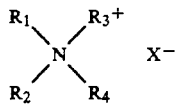

wherein $R_1$ and $R_2$ represent hydrocarbyl groups from about 12 to about 24 carbon atoms; $R_3$ and $R_4$ represent hydrocarbyl groups containing from 1 to about 4 carbon atoms; and X is an anion, preferably selected from halide, methyl sulfate and ethyl sulfate radicals. Representative examples of these quaternary softeners include ditallow dimethyl ammonium chloride; ditallow dimethyl ammonium methyl sulfate; dihexadecyl dimethyl ammonium chloride; di(hydrogenated tallow alkyl) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; di(coconut alkyl) dimethyl ammonium chloride. Ditallow dimethyl ammonium chloride, di(hydrogenated tallow alkyl) dimethyl ammonium chloride, di(coconut alkyl) dimethyl ammonium chloride and di(coconut alkyl) dimethyl ammonium methosulfate are preferred.

Another class of preferred water-insoluble cationic materials are the alkylimidazolinium salts believed to have the formula:

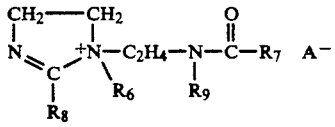

wherein $R_6$ is an alkyl or hydroxyalkyl group containing from 1 to 4, preferably 1 or 2 carbon atoms, $R_7$ is an alkyl or alkenyl group containing from 8 to 25 carbon atoms, $R_8$ is an alkyl or alkenyl group containing from 8 to 25 carbon atoms, and $R_9$ is hydrogen or an alkyl containing from 1 to 4 carbon atoms and $A^-$ is an anion, preferably a halide, methosulfate or ethosulfate. Preferred imidazolinium salts include 1-methyl-1-(tallowylamido-) ethyl -2-tallowyl- 4,5-dihydro imidazolinium methosulfate and 1-methyl-1- (palmitoylamido)ethyl -2-octadecyl-4,5- dihydroimidazolinium chloride. Other useful imidazolinium materials are 2-heptadecyl-1-methyl-1- (2-stearylamido)- ethylimidazolinium chloride and 2-lauryl-1-hydroxyethyl-1-oleyl-imidazolinium chloride. Also suitable herein are the imidazolinium fabric softening components of U.S. Pat. No. 4,127,489, incorporated by reference. As used herein the term "fabric softening agent" excludes, cationic detergent active materials which have a solubility above 10 g/1 in water at 2° C. at a pH of about 6.

Preferred fabric softening agents include water-insoluble tertiary amines having the general formula:

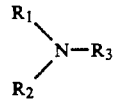

wherein $R_1$ is a $C_{10}$–$C_{26}$ alkyl or alkenyl group, $R_2$ is the same as $R_1$ or if $R_1$ is a $C_{20}$–$C_{26}$ alkyl or alkenyl group, may be a $C_1$–$C_7$ alkyl group and $R_3$ has the formula $—CH_2—Y$, wherein Y is H, $C_1$–$C_6$ alkyl

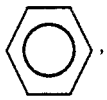

$—CH_2OH$, $—CH{=}CH_2$, $—CH_2CH_2OH$,

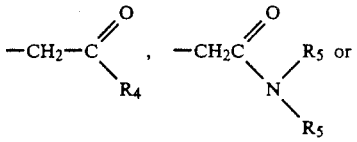

wherein $R_4$ is a $C_1$–$C_4$ alkyl group, each $R_5$ is independently H or $C_1$–$C_{20}$, and each $R_6$ is independently H or $C_1$–$C_{20}$ alkyl.

Preferably $R_1$ and $R_2$ each independently represent a $C_{12}$–$C_{22}$ alkyl group, preferably straight-chained and $R_3$ is methyl or ethyl. Suitable amines include: didecyl methylamine; dilauryl methylamine; dimyristyl methylamine; dicetyl methylamine; distearyl methylamine; diarachidyl methylamine; dibehenyl methylamine; arachidyl behenyl methylamine or di (mixed arachidyl/behenyl) methylamine; di (tallowyl) methylamine; arachidyl/behenyl dimethylamine and the corresponding ethylamines, propylamines and butylamines. Especially preferred is ditallowyl methylamine. This is commercially available as Armeen M2HT from AKZO NV, as Genamin SH301 from FARBWERKE HOECHST, and as Noram M2SH from the CECA COMPANY.

When Y is 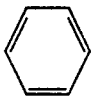 , $—CH{=}CH_2$, $—CH_2OH$, $—CH(OH)—CH_3$ or $—CH_2—CN$, suitable amines include: didecyl benzylamine; dilauryl benzylamine; dimyristyl benzylamine; dicetyl benzylamine; distearyl benzylamine; dioleyl benzylamine; dilinoleyl benzylamine; diarachidyl benzylamine; dibehenyl benzylamine; di (arachidyl/behenyl) benzylamine, ditallowyl benzylamine and the corresponding allylamines, hydroxy ethylamines, hydroxy propylamines and 2-cyanoethylamines. Especially preferred are ditallowyl benzylamine and ditallowyl allylamine.

Mixtures of any of these amines may be used.

When the fabric softening agent is a soap, this includes not only the usual alkali metal and alkaline earth metal salts of fatty acids, but also the organic salts which can be formed by complexing fatty acids with organic nitrogen-containing materials such as amines and derivatives thereof. Usually, the soap comprises salts of higher fatty acids containing from 8 to 24 carbon atoms, preferably from 10 to 20 carbon atoms in the molecule, or mixtures thereof.

Preferred examples of soaps include sodium stearate, sodium palmitate, sodium salts of tallow, coconut oil and palm oil fatty acids and complexes between stearic and/or palmitic fatty acid and/or tallow and/or coconut oil and/or palm oil fatty acids with water-soluble alkanolamines such as ethanolamine, di- or triethanolamine, N-methylethanol- amine, N-ethylethanolamine, 2-methylethanolamine and 2,2-dimethyl ethanolamine and N-containing ring compounds such as morpholine, 2'-pyrrolidone and their methyl derivatives.

Mixtures of soaps can also be employed.

Particularly preferred are the sodium and potassium salts of the mixed fatty acids derived from coconut oil and tallow, that is sodium and potassium tallow and coconut soap.

We have found particularly beneficial effects when the fabric softening agent is a mixture of soap and either a cationic fabric softening agent or a fatty amine.

The fabric softening additive comprises the fabric softening agent and the cellulose ether in intimate mixture. This means that substantially all the particles of the additive contain both components. Of course, it is possible for a minor amount of the additive to be in the form of particles which do not contain both components, but there is no advantage in this.

We are aware of U.S. Pat. No. 3,920,561 (Des Marais) which in Example II thereof describes a solid composition containing a quaternary ammonium fabric softener, a cellulose ether which is described as a methyl cellulose with a DS (methyl) of 2.31 and a gel point of 40° C. and a large excess (90%) of sodium carbonate. Such compositions where the softener and the cellulose ether constitute only a minor part of the composition do not form part of the present invention.

A suitable method of preparing the additive, when the fabric softening agent has a suitably low melting point, is to melt the fabric softening agent and then to disperse the cellulose ether therein. The liquid mixture is then cooled to a solid, which may be ground and sieved to the required particle size.

An alternative method of forming the additive is to spray-dry the two components either in the absence of other materials or in the presence of minor amounts thereof.

The compositions to which the fabric softening additives according to the invention can be added contain a non-soap anionic detergent active material, which may be mixed with other non-soap detergent compounds selected from nonionic, zwitterionic and amphoteric synthetic detergent active materials. Many suitable detergent compounds are commercially available and are fully described in the literature, for example in "Surface Active Agents and Detergents", Volumes I and II, by Schwartz, Perry and Berch.

Anionic detergent active materials are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides or methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to product a random sulphonate; and olefin sulphonates, which term is used to describe the material made by reacting olefins, particularly $C_{10}$ –$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Suitable nonionic detergent compounds which may be used include in particular the reaction products of compounds having a hydrophobic group in a reactive hydrogen atom, for example aliphatic alcohols, acids, amides or alkyl phenols with alkylene oxides, especially ethylene oxide either along or with propylene oxide. Specific nonionic detergent compounds are alkyl ($C_6$–$C_{22}$) phenols-ethylene oxide condensates, generally 5 to 25 EO, i.e. 5 to 25 units of ethylene oxide per molecule, the condensation products of aliphatic ($C_8$–$C_{18}$) primary or secondary linear or branched alcohols with ethylene oxide, generally 5 to 40 EO, and products made by condensation of ethylene oxide with the reaction products of propylene oxide and ethylenediamine. Other so-called nonionic detergent compounds include long chair tertiary amine oxides, long chair tertiary phosphine oxides and dialkyl sulphoxides.

Mixtures of anionic and nonionic compounds may be used in the detergent compositions, particularly to provide controlled low sudsing properties. This is beneficial for compositions intended for use in suds-intolerant automatic washing machines.

Amounts of amphoteric or zwitterionic detergent compounds can also be used in the compositions of the invention but this is not normally desired due to their relatively high cost. In any amphoteric or zwitterionic detergent compounds are used it is generally in small amounts.

The effective amount of the detergent active compound or compounds used in the composition of the present invention is generally in the range of from 2 to 50%, preferably from 5 to 40% by weight, most preferably not more than 30% by weight of the composition.

The compositions, to which the additives of the invention may be added, will generally include a detergency builder to improve the efficiency of the detergent active, in particular to remove calcium hardness ions from the water and to provide alkalinity. The builder material may be selected from precipitating builder materials (such as alkali metal carbonates, bicarbonates, borates, orthophosphates and silicates), sequestering builder materials (such as alkali metal pyrophosphates, polyphosphates, amino polyacetates, phytates, polyphosphates, aminopolymethylene phosphonates and polycarboxylates), ion-exchange builder materials (such as zeolites and amorphous aluminosilicates), or mixtures of any one or more of these materials. Preferred examples of builder materials include sodium tripolyphosphate, mixtures thereof with sodium orthophosphate, sodium carbonate, mixtures thereof with calcite as a seed crystal, sodium citrate, zeolite and the sodium salt of nitrilo- triacetic acid.

The level of builder material in the compositions may be up to 80% by weight, preferably from 20% to 70% by weight and most preferably from 30% to 60% by weight.

Apart from the components already mentioned, the detergent composition can contain any of the conventional additives in the amounts in which such additives are normally employed in fabric washing detergent compositions. Examples of these additives include the lather boosters such as alkanolamides, particularly the monoethanolamides derived from palm kernel fatty acids and coconut fatty acids, lather depressants, oxygen-releasing bleaching agents such as sodium perborate and sodium percarbonate, peracid bleach precursors, chlorine-releasing bleaching agents such as trichloroisocyanuric acid, inorganic salts such as sodium sulphate, and, usually present in very minor amounts, fluorescent agents, perfumes, enzymes such as cellulases, proteases and amylases, germicides and colourants.

The level of fabric softening additives in the composition is such that the fabric softening agent occupies more than 0.5% by weight, such as more than b% by weight in order to provide a noticeable fabric softening benefit. Not more than 50% by weight, preferably not more than 20% by weight of fabric softener is present in the composition to leave room in the formulation for other ingredients. When the fabric softening agent is a soap, a level of less than 10% by weight of the composition is sufficient to provide a fabric softening benefit.

The compositions may be in any convenient form such as bars, powders, pastes or liquids, provided that the fabric softening agent and cellulose ether are in intimate mixture form.

The detergent compositions may be prepared in any way appropriate to their physical form such as by dry-mixing the components, co-agglomerating then or dispersing them in a liquid carrier. However, a preferred physical form is a granule incorporating a detergency builder material and this is most conveniently manufactured by spray-drying at least part of the composition.

The invention will now be illustrated in the following non-limiting examples.

EXAMPLES 1 and 2

Particulate fabric softening additives were prepared as follows.

Arosurf TA100, a commercial fabric softening agent which is approximately distearyl dimethyl ammonium chloride in powder form was melted at about 70° C. An appropriate amount of cellulose ether (to give a ratio of 9:1 to 4:1) was added and dispersed by hand stirring. The mixture was then placed in a refrigerator to cool. The cooled mixture, now in solid form, was ground into a powder by use of a pestel and mortar, followed by use of a coffee grinder. A sieved fraction having a particle size of 100 to 400 microns was used in the following experiments.

A commercially available fabric washing powder having the following approximate composition was used.

| Ingredient | % by weight |
|---|---|
| Anionic detergent active | 5.6 |
| Nonionic detergent active | 3.5 |
| Hardened tallow soap | 2.8 |
| Sodium tripolyphosphate | 21.8 |
| Sodium silicate | 3.8 |
| Sodium perborate | 17.6 |
| Sodium carbonate | 5.0 |
| Sodium sulphate | 30.2 |
| Water and miscellaneous ingredients | balance |

To this composition was added a given quantity of fabric softening additive prepared as described above.

A wash liquor was prepared containing 4 g/1 of the above composition including the additive in water having a hardness of 24° FH. This liquor was used to wash a fabric load containing artifically soiled test cloths together with terry towelling and polyester monitors in a laboratory scale apparatus. The liquor to cloth ratio was about 20:1, the was time was 15 minutes to 50° C. followed by a 2 minute flood at 50% dilution followed by three 5 minute rinses. The fabric load was then line-dried.

After drying, the terry towelling monitors were accessed for softness subjectively by expert judges who assess softness by comparison of pairs of monitors leading to preference scores which are then adjusted to give a score of zero for the control. A positive score indicates better softness than the control.

In a first Example (Example 1), the additive consisted ob 9 parts of Arosurf to 1 part of cellulose ether and was added to a level of 4.4% on the product. In a second example (Example 2) the additive consisted of 4 parts of Arosurf to 1 part of cellulose ether and was added at a level of 5% on the product.

In Examples 1A and 2A respectively compositions were tested which were identical to those used in Examples 1 and 2 except that the Arosurf was separately dry-mixed with the other ingredients rather than being added in the form of an intimate particulate mixture with the cellulose ether polymer and the cellulose ether polymer was added to the was liquor in the form of 10 g/1 solution.

In the control, no Arosurf or cellulose ether was present.

The cellulose ether used in these experiments was BERMOCOLL CSTO35 (ex Berol Kemi) which has a gel point of 35° C., an HLB of 3.4 and a degree of polymerisation of about 180.

The results were:

| Example No. | Overall cellulose ether level (%) | Softening score (3 washes) |
|---|---|---|
| 1 | 0.44 | +0.47 |
| 1A | 0.44 | +0.02 |
| 2 | 1.0 | +0.29 |
| 2A | 1.0 | −0.05 |
| Control | — | −0.73 |

These results show that at both levels of cellulose ether, the incorporation via the additive leads to a better softening performance than separate addition, although clearly in all cases a benefit compared with the control is observed.

When these experiments are repeated with a higher (2%) overall level of cellulose ether a significant softening benefit compared with separate addition was no longer observed, demonstrating that the invention is particularly useful at lower levels of cellulose ether.

EXAMPLE 3

This example shows the importance of the mixture of the cellulose ether and the fabric softening agent constituting at least the major component of the additive, in contrast to the composition described in Example II of U.S. Pat. No. 3,920,561 (Des Marais).

Particulate fabric softening additives were prepared as described in Examples 1 and 2. Their compositions were as follows:

| | Example No. | | | |
|---|---|---|---|---|
| Ingredient (%) | 3A | 3B | 3C | 3D |
| Arosurf TA100 | 7.5 | 7.5 | 83 | 83 |
| Bermcoll CST035 | 1.5 | — | 17 | — |
| Probe D[1] | — | 1.5 | — | 17 |
| Sodium carbonate | 91.0 | 91.0 | — | — |

Note:
[1]Probe D is a DS 2.5 methyl cellulose (ex Hoechst) having a gel point of 33° C. and HLB of 3.01, and a degree of polymerization of about 650.

Wash liquors were prepared containing 5 g/1 of the commercially available fabric washing powder referred to in Examples 1 and 2 and 2.7 g/1 of the above additives in the case of Examples 3C and 3D, but 0.24 g/1 of the above Examples 3A and 3B. These liquors were used to wash fabrics in a similar manner to that described in Examples 1 and 2. The results were:

| Example No. | location of sodium carbonate | Softening score (3 washes) |
|---|---|---|
| 3A | in particle | +1.40 |
| 3B | in particle | 0 |
| 3C | separate | +1.76 |
| 3D | separate | +1.20 |

These results show that in the case of both cellulose ethers used, the additives according to the invention (Examples 3C and 3D) which consist only of the mixture of softener and cellulose ether give better results than when this mixture forms only a minor part of the additive, the balance being made up by sodium carbonate.

I claim:

1. A particulate fabric softening additive for detergent compositions, comprising as the sole or major component, an intimate mixture of a water-soluble nonionic cellulose ether and an organic fabric softening agent selected from the group consisting of quaternary ammonium compounds, imidazolinium derivatives, fatty amines, soaps, organo-modified clays and mixtures thereof in the weight ratio of from 1:1 to 0.06:1, the cellulose ether being an alkyl hydroxyalkyl cellulose in which the alkyl group is selected from methyl and ethyl and the hydroxyalkyl group is selected from hydroxyethyl and hydroxypropyl, the cellulose ether having a degree of substitution of from 1.9 to 3 and from 0.9 to 2.0 alkyl groups and from 0.1 to 2. 0 hydroxyethyl groups per anhydroglucose ring and having an HLB of between 3.3 and 3.8, and a gel point of 33° C. to 56° C.

2. A softening additive according to claim 1, in which the cellulose ether has a degree of substitution of from about 1.9 to about 2.9 substituents per anhydroglucose ring.

3. A softening additive according to claim 1, in which the cellulose ether has a weight average degree of polymerisation of from about 50 to about 1,200.

4. A softening additive according to claim 1, in which the cellulose ether contains from 0.9 to 2.0 alkyl groups and from 0.1 to 2.0 hydroxyethyl groups per anhydroglucose ring.

5. A softening additive according to claim 1, in which the cellulose ether contains about 2.5 methyl groups per anhydroglucose ring.

6. A softening additive according to claim 1, in which the fabric softening agent is selected from quaternary ammonium compounds, imidazolinium derivatives, fatty amines, soaps organo-modified clays and mixtures thereof.

7. A fabric treatment composition comprising:

(i) from 2% to 50% of a non-soap anionic detergent active material or a mixture thereof with other non-soap detergent active materials selected from the group consisting of nonionic, zwitterionic and amphoteric detergent active materials; and (ii) from 0.1% to 53% of the particulate fabric softening additive according to claim 1.

* * * * *